US011225442B2

(12) United States Patent
Dmitrovic et al.

(10) Patent No.: US 11,225,442 B2
(45) Date of Patent: Jan. 18, 2022

(54) VISUAL AND INFRARED SIGNATURE POWDER AND PREPARATION METHODS THEREOF

(71) Applicant: Armtec Defense Products Co., Coachella, CA (US)

(72) Inventors: Radana Dmitrovic, Palm Springs, CA (US); Willie Edward Benjamin, III, La Quinta, CA (US); Rachel Hendrika Newell, Indio, CA (US)

(73) Assignee: Armtec Defense Products Co., Coachella, CA (US)

( * ) Notice: Subject to any disclaimer, the term of this patent is extended or adjusted under 35 U.S.C. 154(b) by 143 days.

(21) Appl. No.: 16/165,931

(22) Filed: Oct. 19, 2018

(65) Prior Publication Data

US 2019/0047919 A1 Feb. 14, 2019

Related U.S. Application Data

(63) Continuation of application No. 14/838,220, filed on Aug. 27, 2015, now Pat. No. 10,106,473.

(60) Provisional application No. 62/043,968, filed on Aug. 29, 2014.

(51) Int. Cl.

| | |
|---|---|
| ***C06B 45/00*** | (2006.01) |
| ***C06B 43/00*** | (2006.01) |
| ***C06B 45/30*** | (2006.01) |
| ***C06C 15/00*** | (2006.01) |
| *D03D 23/00* | (2006.01) |
| *D03D 43/00* | (2006.01) |

(52) U.S. Cl.

CPC ..... *C06B 43/00* (2013.01); *C06B 45/30* (2013.01); *C06C 15/00* (2013.01)

(58) Field of Classification Search

USPC .... 149/2, 108.2, 108.6, 108.8, 109.4, 109.6, 149/190.4

See application file for complete search history.

(56) References Cited

U.S. PATENT DOCUMENTS

| | | | | |
|---|---|---|---|---|
| 2,805,145 | A * | 9/1957 | Henderson | C22B 5/04 75/567 |
| 3,774,022 | A | 11/1973 | Dubrow et al. | |
| 3,808,414 | A | 4/1974 | Roberts | |
| 4,678,608 | A | 7/1987 | Dugliss | |
| 4,880,483 | A * | 11/1989 | Baldi | B65D 43/022 149/6 |
| 5,028,385 | A | 7/1991 | Baldi | |
| 5,135,569 | A | 8/1992 | Mathias | |
| 5,281,367 | A | 1/1994 | Schleck et al. | |
| 6,126,871 | A | 10/2000 | Cranor | |
| H1948 | H | 3/2001 | Rusek et al. | |

(Continued)

OTHER PUBLICATIONS

International Searching Authority, International Search Report and Written Opinion, PCT Patent Application PCT/US2013/044389, dated Oct. 31, 2013, 9 pages.

*Primary Examiner* — James E McDonough
(74) *Attorney, Agent, or Firm* — Perkins Coie LLP

(57) ABSTRACT

Provided herein are VIS-IR powders comprising tin which show significantly higher visual intensity, reduced reaction temperature and particle temperature during and after oxidation reaction in air, and improved resistance to clumping when compared to comparable powders without tin. Methods of preparation of said VIS-IR powders are also disclosed.

15 Claims, 2 Drawing Sheets

(56) References Cited

U.S. PATENT DOCUMENTS

| | | | | |
|---|---|---|---|---|
| 7,487,728 | B2 | 2/2009 | Cranor | |
| 10,106,473 | B2 | 10/2018 | Dmitrovic et al. | |
| 2005/0254227 | A1 | 11/2005 | Bilodeau | |
| 2010/0139823 | A1* | 6/2010 | Gash | C06B 45/00 149/17 |
| 2011/0085318 | A1 | 4/2011 | Cranor et al. | |
| 2011/0308420 | A1* | 12/2011 | Mutascio | C22C 1/0491 102/513 |
| 2012/0020050 | A1 | 1/2012 | Longo | |
| 2012/0097063 | A1 | 4/2012 | Cranor et al. | |
| 2014/0013988 | A1 | 1/2014 | Newell et al. | |
| 2014/0013989 | A1 | 1/2014 | Newell et al. | |
| 2017/0158955 | A1 | 6/2017 | Newell et al. | |

* cited by examiner

VISUAL AND INFRARED SIGNATURE POWDER AND PREPARATION METHODS THEREOF

CROSS-REFERENCE TO RELATED APPLICATIONS

This application is a continuation of U.S. patent application Ser. No. 14/838,220, filed Aug. 27, 2015, which claims the benefit of U.S. Provisional Application No. 62/043,968, filed Aug. 29, 2014, both of which are incorporated herein by reference in their entirety, including drawings.

TECHNICAL FIELD

The present disclosure relates generally to visual and infrared (VIS-IR) signature radiation and, more particularly, to infrared (IR) signature powder and methods of controlling the temperature, duration, and intensity of visual and infrared signature radiation.

BACKGROUND

Industries have many uses for visual and infrared (VIS-IR) signature materials. For example, these materials are used as part of law enforcement or military training exercises and in operations to mark targets and other objects. Additionally, they may be used to make a cloud in front of a target, to obscure the target. Many different imaging technologies are used by the military and law enforcement, so a material that gives an intense signature across a wide range of wavelengths is desirable. In many cases, the same material needs to be visible with the naked eye, near-infrared night vision goggles, mid-wave thermal sights, and/or long-wave thermal sights.

Historically, pyrotechnic compositions have been used as signature materials. However, pyrotechnic compositions are inherently energetic, and if these materials fail to initiate at the proper time, they can become a safety hazard. User might want to control the duration, temperature and/or intensity of the visual and/or the infrared signature radiation as needed for different operations or training situations. Additionally, many pyrotechnic compositions contain ingredients that are toxic or hazardous to the environment. Other signature materials, such as clouds of colored dust or chemiluminescent formulations, have been employed to address these problems. However, these solutions have limited applications as clouds of dust are only visible during daylight and chemiluminescent formulations are not bright enough for daytime visibility and provide minimal thermal signature.

Very small particles of many metals may be pyrophoric. Pyrophoric powders may also be made by reducing iron compounds such as iron oxalate or iron oxide. Another approach is to combine iron and aluminum at high temperatures to form an iron aluminide composite. The aluminum may then be removed through a caustic leaching procedure, leaving behind a high surface area pyrophoric iron. The caustic leaching procedure is commonly used to make pyrophoric foils (as described in U.S. Pat. Nos. 4,435,481, 4,895,609, 4,957,421, 5,182,078, 6,093,498, 6,193,814 and others). Powders may be formed by grinding foils, scraping pyrophoric powder off the foils, or by sintering the iron and aluminum to together to make a brick that is ground into powder prior to leaching (see, for example, U.S. Pat. No. 5,194,219).

Prior art discloses the use of tin in activated iron systems U.S. Pat. Nos. 4,435,481, 4,895,609, 4,957,421, 4,965,095, 4,970,114, 5,028,385, 5,194,219, and 5,262,466 disclose using tin, typically as $SnCl_2$, in the caustic leaching solution used to activate the iron. As discussed in U.S. Pat. No. 6,093,498, it is believed that the tin salt in the leaching solution results in deposition of tin metal that prevents oxidation of the activated iron in the leaching solution.

Additionally, U.S. Pat. No. 6,093,498 discloses a system that uses tinplated steel as the pyrophoric substrate. In this system, the tin is believed to aid in the diffusion of aluminum into the steel. The inventors report that using tinplated steel aided in processing because the performance was much less sensitive to the leaching time. Additionally, the activated iron made from tinplated steel gave a greater energy output with a higher peak temperature and longer heat generation time than iron made from a substrate without the tinplate. Close interaction of the iron in the substrate and tin was accomplished by using tinplated steel.

U.S. Pat. No. 8,783,186 discloses adding combustible elements such as nickel or boron to the payload to increase the visible and thermal output of the signature. While igniting secondary fuels with the pyrophoric material can certainly increase the output, it also has the disadvantage that many of these materials burn at very hot temperatures, so the fire hazard or the risk of potential heat damage can be significantly increased. All of the above-identified patents are hereby incorporated herein in their entireties by reference thereto.

DETAILED DESCRIPTION OF THE INVENTION

Figure 1:
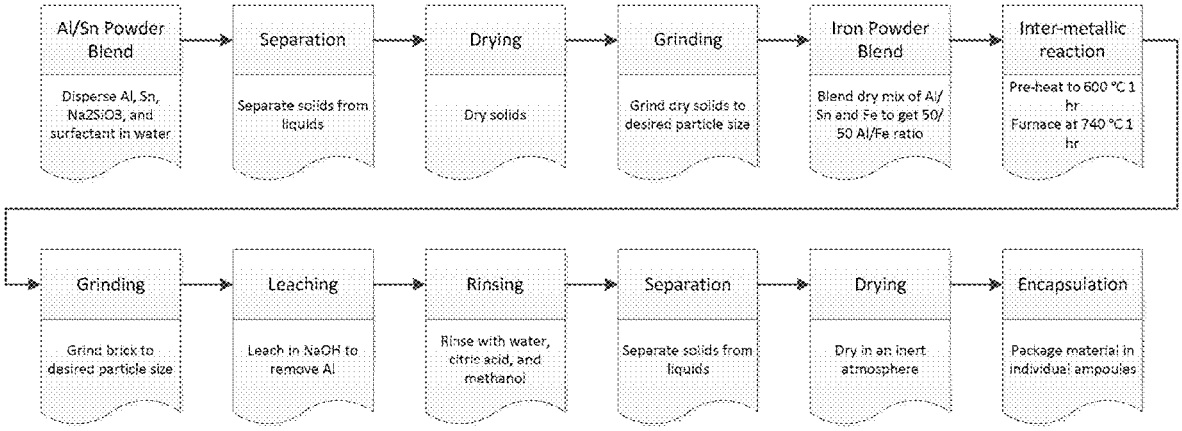
FIG. 1 illustrates an embodiment of a method of producing the VIS-IR powder as disclosed herein.

This application uses a process similar to the one disclosed in U.S. Pat. No. 5,194,219 to make pyrophoric powder, with at least some of the improvements being related to including tin and other additives in the formulation. In the system and process of the present disclosure, a method of incorporating tin into a powdered pyrophoric material is disclosed. In this disclosure, the close interaction of the iron and tin is accomplished by mixing iron and tin powders. Applicant's technology is further improved by incorporating binders and other processing aids to enhance the interaction of iron and tin. In this technology, the signature is enhanced by changing the formulation method of the pyrophoric material itself, so no secondary fuels are required. This allows an enhanced signature to be generated without increasing the temperature of the material.

Pyrophoric materials that create a visual and infrared signature address many of the limitations of pyrotechnic and other signature materials. They are similar to pyrotechnics in that they employ the reaction between a fuel and an oxidizer to produce visible and infrared radiation. However, in the case of pyrophoric materials, the oxidizer is the oxygen in the air and the payload material is not exposed to the oxygen until the moment of activation. Since the oxidizer is not part of the composition, the pyrophoric material does not pose an explosive hazard.

The rate of reaction for the pyrophoric iron disclosed in Applicant's technology is related to the rate of oxygen exposure. When the pyrophoric iron powder is dispersed in a cloud, there is sufficient oxygen for rapid reaction (less than a second), and an intense visual and thermal signature is produced. However, inadvertent exposure to air through cracking of the storage container typically does not result in sufficient dispersion of the powder to obtain rapid reaction. In this situation, the powder slowly deactivates as oxygen diffuses through the powder over a matter of hours or days. Therefore, payloads that do not activate do not pose an unexploded ordnance hazard.

Increasing the intensity of signature that can be obtained from a given amount of material has many advantages. The same amount of material can be seen from a greater distance or with greater clarity, increasing operational effectiveness. Alternatively, the amount of material can be reduced to reduce cost and weight. The ability to reduce the amount of material required also opens possibilities for applications where very little space is available for payloads.

While intense signatures offer many advantages, increasing the thermal signature also carries with it the risk of increasing the fire hazard of the material. Many operations and training exercises take place in areas with significant amounts of combustible materials, so using a signature material with a high fire hazard is unacceptable. Since solid particles remain after the reaction, hot particles that fall to the ground after the reaction are a particular hazard.

The disclosed technology relates to a pyrophoric powder that is particularly favorable for applications as a signature material. The advantages over prior art pyrophoric materials are that this material has a brighter visible signature, has residual particles with a lower temperature, and is less susceptible to clumping. Additionally, the duration of the signature is tailorable.

In accordance with aspects of the technology disclosed herein, a visual and infrared signature material comprising pyrophoric iron powder is provided. This material may be encapsulated in a carrier (such as in an ampoule) that is substantially free of oxygen, to isolate the material from oxygen until activation of the signature material is required. When the carrier (e.g., ampoule) is broken, the pyrophoric iron powder is exposed to oxygen, and is oxidized with visual and thermal radiations emitted in the process.

One aspect of the technology relates to a method of manufacturing a visual and infrared signature material (VIS-IR powder). In certain embodiments, the method comprises combining aluminum, tin, and iron particles (e.g., with a binder) to enhance particle interactions. In certain embodiments, the VIS-IR powder obtained with the method disclosed herein has an enhanced visual signature and a reduced maximum temperature.

In one embodiment, the method comprises:

1a. mixing a first metal composition with a binder composition with a first solvent to provide a first mixture, wherein the first metal composition comprises aluminum and tin, and the binder composition comprises one or more binder components commonly used for inorganic powders, include, without limitations, dispersants, organic binders, wetting agents, lubricants, silicate binders, and metasilicate binders, and the binder composition may disperse in the first solvent;

1b. separating solid from liquid from the first mixture and drying the solid to provide a first solid;

1c. combining the first solid with a second metal composition to provide a second mixture, wherein the second metal composition comprises particles of one or more metals selected from the group consisting of iron, nickel, cobalt, titanium, and zirconium;

1d. heating the second mixture to provide a first inter-metallic composition;

1e. grinding the first inter-metallic composition (e.g., to a desired size or a mixture of sizes) to provide a ground first inter-metallic composition;

1f. adding the ground first inter-metallic composition to a leaching solution comprising one or more strong bases (e.g., NaOH, KOH, etc.) and providing a leached mixture;

1g. separating solid from liquid from the leached mixture to provide a second solid;

1h. rinsing the second solid with one or more rinsing solutions; and 1i. drying the second solid to provide the VIS-IR powder.

Examples of silicate binders include, without limitation, sodium silicate, potassium silicate, lithium silicate, and alkyl ammonium silicates (e.g., tetramethyl ammonium silicate). Examples of metasilicate binders include, without limitation, sodium metasilicate, potassium metasilicate, lithium metasilicate, and alkyl ammonium metasilicates (e.g., tetramethyl ammonium metasilicate).

When silicate binders (e.g., sodium silicate, potassium silicate, lithium silicate) and/or metasilicate binders (e.g., sodium metasilicate, potassium metasilicate, lithium metasilicate) are soluble in aqueous solution, the first solvent may be water, an aqueous buffer (e.g., with a neutral pH), or an aqueous solution (e.g., further comprising one or more corrosion inhibitors, e.g., alkyl phosphates, inorganic phosphates, phosphonates, and alkyl ammonium halide salts). Silicate binders, e.g., sodium silicate, potassium silicate, lithium silicate, and alkyl ammonium silicates, may also act as corrosion inhibitors, and thus may be preferred. The silicate binders and/or metasilicate binders may be applied to the particles as an aqueous solution. When silicate binders (e.g., lithium silicate or alkyl ammonium silicate) and/or metasilicate binders (e.g., lithium metasilicate or alkyl ammonium metasilicate) are soluble in an organic solvent, examples of the first solvent include, without limitation, toluene, hexane, cyclohexane, MEK, MBA, alcohols, esters, dioxane, tetrahydrofuran, acetone, and any mixtures thereof. Organic-soluble silicates and/or organic-soluble metasilicates may be applied through a solution in an organic solvent.

The binder composition may comprise one or more dispersants (e.g., lignosulfates, sulfonated naphthalene, sulfonated melamine formaldehyde and polycarboxylate) that may help reduce clumping to improve homogeneity of mix.

Examples of organic binders include, without limitation, starch, cellulose, polyvinyl alcohol, and wax.

The binder composition may comprise one or more wetting agents to increases the spread of the material and enhance the performance of silicate and/or metasilicate binders. Examples include, without limitation, anionic surfactants and non-ionic surfactants. One embodiment uses ethoxylated-2,5,8,11-tetramethyl-6-dodecyn-5,8-diol (trade name Dynol 604) as a non-ionic surfactant.

The binder composition may comprise one or more lubricants to improve particle flow, and provide more efficient compaction of the powders. Examples of the suitable lubricants include, without limitation, surfactants, phosphates, glycols, olefins, glucosides, asphaltenes, and esters. In at least one embodiment, the binder composition also has lubricating properties. An embodiment that uses sodium silicate as the silicate binder and Dynol 604 as the surfactant does not required the addition of a separate lubricant because of the lubricating properties of the silicate binder and the surfactant.

In another embodiment, the method comprises:

2a. mixing the dry particles of a first metal composition with a binder composition comprising one or more metasilicate binders (e.g., sodium metasilicate, lithium metasilicate, and potassium metasilicate) to provide a first mixture, wherein the first metal composition comprises aluminum and tin;

1c'. combining the first mixture with a second metal composition to provide a second mixture, wherein the second metal composition comprises particles of one or more metals selected from the group consisting of iron, nickel, cobalt, titanium, and zirconium; and steps 1d-1i as disclosed supra.

The binder composition may further comprise other binders commonly used for inorganic powders, include, without limitations, dispersants (e.g., lignosulfates, sulfonated naphthalene, sulfonated melamine formaldehyde and polycarboxylate) that may help reduce clumping to improve homogeneity of mix; organic binders (e.g., starch, cellulose, polyvinyl alcohol, and wax); wetting agents; and lubricants, as disclosed supra.

In certain embodiments, the first solid comprises aluminum, tin, sodium silicate, and surfactant Dynol 604, and the second metal composition comprises iron. The weight of aluminum and iron may be the same, or be different ratios in the mixture. The second metal composition may further comprises nickel, cobalt, titanium, and/or zirconium in place of or in addition to iron.

The intermetallic composition may be formed by heating the second mixture at a first temperature (e.g., about 500° C. to about 600° C., or about 600° C.) for a first period of time (e.g., about 1 to about 3 hours, or about 1 hour), and then holding at a second temperature (e.g., about 700° C. to about 760° C., or about 740° C.) for a second period of time (e.g., about 1 to about 3 hours, or about 1 hour), wherein, the melting point of the aluminum-tin eutectic (e.g., 228° C.) is lower than the first and the second temperature. Thus, a liquid phase forms during the heat cycle which facilitates the interaction of aluminum with iron.

The intermetallic composition may then be cooled to room temperature and ground to a desired size (e.g., about 60 mesh) or a mixture of desired sizes; and may be further separated according to particle sizes (e.g., by a classifier).

The ground intermetallic composition may be added to the leaching solution under a fume hood. In certain embodiments, the intermetallic composition was added to the leaching solution in small increments to control the active reaction between the intermetallic composition and the leaching solution.

In one embodiment, the leaching solution is a base (e.g., NaOH, KOH) at various concentrations (e.g., about 12.5% to about 25% NaOH, or about 20% NaOH) to remove aluminum from the intermetallic composition (i.e., leaching). To ensure proper leaching, the amount of the sodium hydroxide used can be 2 or 3 times the amount (by weight) of the aluminum in the formed intermetallic composition. A mixer may be used to ensure proper mixing between the leaching solution and the formed composition.

In certain embodiments, the solution may be heated to a third temperature (e.g., about 80° C. to about 90° C.) until most of the aluminum is leached out, or until intense bubbling ceases, indicating that the reaction is substantially complete. During this process, hydrogen gas (approximately 1 liter) may be produced per gram of aluminum. The leaching process dissolves the aluminum from the formed composition to leave behind pyrophoric iron and tin.

In one embodiment, an exhaust scrubber may be used to ensure proper recycling and regeneration of the gases generated during the leaching process.

The second solid (e.g., the solid pyrophoric iron) is separated from the caustic leaching solution and rinsed with one or more rinsing solutions (e.g., water, aqueous solutions, and/or organic solvents). When there are multiple rinsing solutions, the multiple rinsing solutions may be applied together or separately. In one embodiment, the rinsing solution further comprises one or more acids (e.g., citric acid) to neutralize the NaOH. In another embodiment, the second solid is also rinsed with an organic solvent comprising one or more alcohols (e.g., methanol, ethanol, and t-butanol) or other organic solvents to facilitate water removal from the pores. During the rinsing stage, the second solid is pyrophoric, but protected from exposure to oxygen by being stored under liquid. As there may be some oxygen that dissolves in the liquid, long-term storage of the second solid under the liquid may result in some degradation, and is not recommended.

After rinsing, the second solid is dried in an inert atmosphere to provide VIS-IR powder. The dried VIS-IR powder may be used as-is, or the VIS-IR powder may be classified to provide VIS-IR powders with the desired particle sizes.

Optionally, the method further comprises packing dried VIS-IP powder into carriers (e.g., ampoules) that are substantially oxygen free.

Another aspect of the technology relates to the VIS-IR powder prepared according to the method disclosed herein, which comprises tin.

The VIS-IR powder as disclosed herein has shown various advantages over comparable formulations without tin, including, without limitation:

- significantly higher visual intensity (see, e.g., Table 1);
- reduced temperature over the oxidation reaction when exposed to air (e.g., maximum reaction temperature lowered up to ~40° C., see Table 2) and the powder residues after the reaction (see, e.g., FIG. 2) when compared to comparable composition without tin; and
- improved resistance to clumping when compared to comparable composition without tin.

The VIS-IR powder provides a reduced temperature of the reaction. Compositions of the present technology formed a gray cloud when dispersed in air. One of the effects of this cloud may be that some of the heat is contained in the cloud and could be slowly dissipated to the air instead of falling to the ground where combustible materials may be present. This cloud may comprise primarily of tin and tin oxide, which may indicate that tin or tin oxide is being vaporized during the reaction. Furthermore, vaporization may also remove heat from the reaction.

The presence of tin in the VIS-IR powder may also reduce the temperature of the hot particles that fall to the ground. When a pyrophoric powder that does not contain tin is exposed to air, the particles appear visually the same before and after the reaction. However, the particles of the VIS-IR powder as disclosed herein become more granular through the reaction, which may be due to melting of tin during the reaction, without being bound by the mechanism. Accordingly, the temperature of the residue particles may be further reduced by the heat of fusion required to melt the tin.

Furthermore, the VIS-IR powder as disclosed herein has improved resistant to clumping. −60 to +200 mesh particles of a comparable formulation without tin are susceptible to clumping and may require the addition of an anti-clumping agent. However, the same size particles of the VIS-IR powder as disclosed herein (with tin) does not clump, such that anti-clumping agents are not needed.

The duration of the reaction of the pyrophoric iron with tin may be designed and controlled by adjusting a number of different factors during the preparation. For example, without limitation, the reaction's duration may be controlled based on the concentration of the silicate binders (e.g., sodium silicate) and/or the metasilicate binders; the particle sizes; and the particle morphology.

In certain embodiments, the VIS-IR powder as disclosed herein are packaged in individual carriers (e.g., ampoules) that are substantially oxygen free.

Another aspect of the technology relates a carrier (e.g., ampoule) comprising the VIS-IR powder as disclosed herein, wherein the carrier (e.g., ampoule) is substantially oxygen free. The carrier (e.g., ampoule) may be made of a material substantially impervious to air-penetration and that has a suitable shelf-life. In one embodiment, the carrier (e.g., ampoule) is made of borosilicate glass, although other embodiments may use other suitable frangible materials.

Example 1. VIS-IR powders showed significant benefits compared to.

In one example, aluminum, tin, sodium silicate, and Dynol 604 were dispersed in an aqueous solution to allow even coating of the particles with the sodium silicate binder. The powder mixture was then separated from the water and dried and ground to the desired particle size.

The resultant powder containing aluminum, tin, sodium silicate, and surfactant Dynol 604 was combined with iron. In one embodiment, this combination was made to obtain equal parts of aluminum and iron by weight in the mixture. Other embodiments may have mixtures with different ratios of aluminum and iron. In further embodiments, other metals such as nickel, cobalt, titanium, and/or zirconium can be used in place of or in addition to iron.

The intermetallic composition was formed by heating the mixture at 600° C. for 1 hour, and then holding at 740° C. for 1 hour. Since the melting point of the aluminum-tin eutectic was 228° C., a liquid phase formed during the heat cycle which facilitated the interaction of aluminum with iron. The intermetallic composition was then cooled to room temperature.

Once the formed intermetallic composition was cooled to room temperature, it was placed in a grinder. In one embodiment, the cooled composition was ground to approximately −60 mesh particle size. In other embodiments, the cooled intermetallic composition can be ground to different sizes, or to a mixture of sizes. A classifier can be used to separate the ground material as a function of size.

The ground intermetallic composition was then added to a leaching solution under a fume hood. The reaction between the intermetallic composition and the leaching solution could be very active. In some embodiments, the intermetallic composition was added to the leaching solution in small increments. In one embodiment, the leaching solution was 20% NaOH. In other embodiments, different concentrations of NaOH may be used and different hydroxide sources, such as KOH may be used. To ensure proper leaching, the amount of the sodium hydroxide used can be approximately 2-3 times of the amount (by mass) of the aluminum in the formed intermetallic composition. For example, when 200 grams of intermetallic composition included 100 grams of aluminum, approximately 1,350 g of the 20% sodium hydroxide solution was used in the leaching solution. In other embodiments, other proportions of sodium hydroxide can be used. A mixer was used to ensure proper mixing between the leaching solution and the formed composition. In one embodiment, the solution was heated to 80° C.-90° C. until most of the aluminum was leached out, or until intense bubbling ceased, indicating that the reaction was substantially complete. During this process, approximately 1 liter of hydrogen gas was produced per gram of aluminum. The leaching process served to dissolve the aluminum from the formed composition to leave behind pyrophoric iron and tin. In one embodiment, an exhaust scrubber was used to ensure proper recycling and regeneration of the gases generated during the leaching process.

In certain embodiments, the solid pyrophoric iron was removed from the caustic leaching solution and rinsed with water. In one embodiment, citric acid was included in the rinsing solution to neutralize the NaOH. In one embodiment, the powder was also rinsed with an organic solvent, such as methanol, ethanol, or t-butanol, to facilitate water removal from the pores. During the rinsing stage, the powder was pyrophoric, but it was protected from exposure to oxygen by storing under liquid. As there was some oxygen that dissolves in the liquid, long-term storage resulted in some eventual degradation. After rinsing, the powder was dried in an inert atmosphere (e.g, in vacuum oven inside a glove box) to provide a VIS-IR powder. In one embodiment, the dried VIS-IR powder was used as-is, in another embodiment, the VIS-IR powder may be classified to obtain the desired particle sizes.

The VIS-IR powder, which may also be referred to as pyrophoric iron powder, while in the oxygen-free environment, was encapsulated in an oxygen free carrier to ensure that the VIS-IR powder is not prematurely activated while in the carrier (e.g., ampoule). In one embodiment, a selected amount of the VIS-IR powder was encapsulated in individual ampoules. The ampoules were made of a material substantially impervious to air-penetration and that has a suitable shelf-life. In one embodiment, the ampoule was made of borosilicate glass, although other embodiments may use other suitable frangible materials.

When the VIS-IR powder was exposed to air outside the ampoule, the pyrophoric iron oxidized. Addition of tin increased the energy output of the pyrophoric iron of the VIS-IR powder. Aluminum and tin formed an eutectic composition with a melting point of 228° C. This liquid phase during the inter-metallic reaction enhanced the interaction of aluminum with iron. Without being bound by any mechanism, the result may be due to pyrophoric iron particles having higher surface area after leaching. The VIS-IR powder prepared according to the method disclosed herein provided a material with significantly higher visual intensity. Table 1 shows a comparison of the intensity of a pyrophoric iron containing tin according to the method disclosed herein (VIS-IR powder) and a pyrophoric iron that does not contain tin.

TABLE 1

Intensity of pyrophoric ion powder with tin (VIS-IR powder) or without tin

| Pyrophoric iron powders | Max Scotopic (lux) | Integrated Scotopic (lux * s) | Max Photopic (lux) | Integrated Scotopic (lux * s) | 3-5 μm (watts/steradian) | 3-5 μm (watts * s/steradian) | 8-12 μm (watts/steradian) | 8-12 μm (watts * s/steradian) |
|---|---|---|---|---|---|---|---|---|
| Without tin | 44.52 | 6.90 | 118.9 | 18.92 | 63.85 | 11.25 | 30.35 | 11.13 |
| With tin (VIS-IR powder) | 626.80 | 85.30 | 1538.26 | 210.64 | 57.63 | 14.84 | 31.58 | 18.92 |

*Data collected with radiometers placed 75" away from the signature. 5 grams of pyrophoric material in a glass vial was launched at approximately 30 meters/second against a steel plate to disperse the powder.

Additionally, tin reduced the reaction temperature of the VIS-IR powder. The VIS-IR powder formed a gray cloud when dispersed in air. Some of the reaction heat was contained in the cloud and could be slowly dissipated to the air instead of falling to the ground where combustible materials may be present. This cloud was collected on a glass surface, and the powder x-ray diffraction analysis showed that it comprised primarily tin and tin oxide. Thus likely, tin or tin oxide was vaporized during the reaction, which also removed heat from the reaction by vaporization heat.

Table 2 shows the maximum reaction temperatures of a pyrophoric iron containing tin prepared according to the method disclosed herein (VIS-IR powder) and a pyrophoric iron that does not contain tin.

TABLE 2

Max reaction temperature of pyrophoric iron powders with tin (VIS-IR powder) and without tin

| Pyrophoric iron powders | Max temperature (° C.) |
|---|---|
| Without tin | 747 |
| With tin (VIS-IR powder) | 709 |

*Temperatures calculated from the intensity a 3-5 μm and 8-12 μm signal intensity using the emissivity-free version of Planck's equation:

$$\text{Signal ratio } (\lambda_1, \lambda_2) = \frac{\lambda_1^5}{\lambda_2^5} \frac{e^{\frac{hc}{\lambda_1 kT}-1}}{e^{\frac{hc}{\lambda_2 kT}-1}}$$

$\lambda_1$ = wavelength 1
$\lambda_l$ = wavelength 2
h = Planck constant
c = speed of light
k = Boltzmann constant
T = absolute temperature (K)

Figure 2:
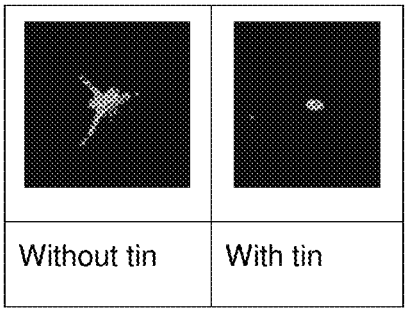
FIG. 2 illustrates temperature differences of particles remained on the ground from dropping the VIS-IR powder disclosed herein (i.e., with tin) and comparable powder (pyrophoric iron powder) without tin.

Tin also reduced the temperature of the hot particles that fell to the ground during or after the reaction of the VIS-IR powder. When a pyrophoric powder that does not contain tin was exposed to air, the particles appeared visually the same before and after the reaction. However, the particles of the VIS-IR powder changed upon exposure to the air, wherein the size of the particles decreased after reaction in air. This may be due to the melting of tin during the reaction. The heat of fusion to melt the tin appeared to reduce the temperature of the particles. A FLIR SC6000 camera with 3-5 μm bandpass was using to observe the residue after 5 grams of VIS-IR powder or a pyrophoric iron powder without tin was dropped onto a concrete floor from a height of 6 ft above the ground. FIG. 2 shows that significantly more hot particles remained on the ground from dropping the pyrophoric iron powder that did not contain tin. Additionally, the max temperature of the particles obtained from the exposure of the VIS-IR powder prepared according to the method disclosed herein to air was approximately 40° C. cooler than that of a pyrophoric iron powder without tin.

Furthermore, the VIS-IR powder was resistant to clumping. −60 to −200 mesh particles of the pyrophoric iron powder without tin are susceptible to clumping and may require the addition of an anti-clumping agent. However, the same size particles of the VIS-IR powder did not clump.

The duration of the reaction of the VIS-IR powder (i.e., pyrophoric iron with tin) may be affected by adjusting a number of different factors during the preparation, e.g., the concentration of sodium silicate, the particle size, and the particle morphology.

Several specific details of the invention are set forth in the description herein to provide a thorough understanding of certain embodiments of the invention. One skilled in the art, however, will understand that the invention may have additional embodiments, and that other embodiments of the invention may be practiced with other specific features and/or without several of the specific features described herein.

From the foregoing, it should be appreciated that specific embodiments of the disclosure have been described herein for purposes of illustration, and not for limitation. Various modifications may be made without deviating from the spirit and scope of the disclosure. Furthermore, while various advantages associated with certain embodiments of the disclosure have been described above in the context of those embodiments, other embodiments may also exhibit such advantages, and not all embodiments need necessarily exhibit all such advantages to fall within the scope of the disclosure.

We claim:

1. A method of preparing a visual and infrared signature composition (VIS-IR powder) comprising:

mixing a first metal composition and a binder composition to provide a first mixture, wherein the first metal composition comprises aluminum and tin;

mixing a first solid comprising at least a portion of the first mixture with a second metal composition to provide a second mixture, wherein the second metal composition comprises pyrophoric iron;

heating the second mixture to provide an intermetallic composition;

adding the intermetallic composition to a leaching solution providing a solid portion and a leached portion that contains the aluminum;

separating the solid portion from the leached portion; and drying the solid portion comprising the tin and pyrophoric iron to provide the VIS-IR powder.

2. The method of claim 1 wherein the binder composition comprises one or more metasilicate binders selected from the group consisting of sodium metasilicate, lithium metasilicate, and potassium metasilicate.

3. The method of claim 1, further comprising heating the first metal composition, and wherein the first mixture is an aluminum-tin eutectic.

4. The method of claim 3, further comprising heating the second mixture at a temperature that is higher than the melting point of the aluminum-tin eutectic.

5. The method of claim 1, further comprising separating solid from liquid from the first mixture and drying the solid to provide the first solid.

6. The method of claim 1, further comprising grinding the intermetallic composition, forming a powder of the intermetallic composition.

7. The method of claim 6 wherein adding the intermetallic composition to the leaching solution is adding the powder of the intermetallic composition to the leaching solution.

8. The method of claim 1 wherein the leaching solution comprises one or more strong bases.

9. The method of claim 8 wherein the one or more strong bases are selected from the group consisting of NaOH and KOH.

10. The method of claim 1, further comprising rinsing the solid portion with one or more rinsing solutions before drying the solid portion.

11. The method of claim 1, further comprising packaging the VIS-IR powder within a carrier that is substantially free of oxygen.

12. The method of claim 11 wherein the carrier comprises a frangible material and wherein the VIS-IR powder is configured to be exposed to oxygen when the frangible material breaks.

13. The method of claim 1 wherein the VIS-IR powder is configured so that the tin is vaporized by thermal radiation emitted by the pyrophoric iron when the pyrophoric iron oxidizes.

14. The method of claim 1 wherein drying the solid portion is executed in an inert atmosphere.

15. The method of claim 1 wherein the VIS-IR powder includes −60 to −200 mesh particles.

* * * * *